United States Patent [19]

Young

[11] 4,401,355

[45] Aug. 30, 1983

[54] FILTERED CONNECTOR

[75] Inventor: William C. Young, Moorestown, N.J.

[73] Assignee: RCA Corporation, New York, N.Y.

[21] Appl. No.: 279,459

[22] Filed: Jul. 1, 1981

[51] Int. Cl.[3] ..... H01R 13/66

[52] U.S. Cl. ..... 339/147 R; 339/17 LC

[58] Field of Search ..... 339/143 R, 147 R, 147 P, 339/17 LC; 333/182, 183

[56] References Cited

U.S. PATENT DOCUMENTS

| | | | |
|---|---|---|---|
| 3,329,911 | 7/1967 | Schlicke et al. | 333/182 |
| 3,456,215 | 7/1969 | Denes | 333/182 |
| 3,854,107 | 12/1974 | Tuchto et al. | 333/79 |
| 3,864,000 | 2/1975 | Coller et al. | 339/17 LC |
| 4,020,430 | 4/1977 | Heyden | 333/79 |
| 4,083,022 | 4/1978 | Nijman | 339/147 R |
| 4,144,509 | 3/1979 | Boutros | 333/181 |
| 4,206,963 | 6/1980 | English et al. | 339/147 R |
| 4,212,510 | 7/1980 | Ritchie et al. | 339/147 R |
| 4,222,626 | 9/1980 | Hollyday et al. | 339/147 R |

OTHER PUBLICATIONS

"AMP Quiet-Line Standard EMI Filter Products," AMP Catalog 78-487, issued Dec. 1979, pp. 4 and 12-15.

"AMP Quiet Line Filters," AMP Catalog 79-519, issued Nov. 1980.

"AMP EMI Filtered Circular Metal Shell Connectors (MIL-C-38999 Type)," AMP Catalog 80-565, issued Mar. 1981, p. 3.

"Filters for Connector Pins," *Spectrum Control Engineering Bulletin,* Bulletin 27-0027-48.

"Connectors, Electrical, Modular, Connector, Type III, Female Contact and Grounding Bushing Set, REmovable Wire Wrappost Terminal," *Military Specification Sheet MIL-C-28754/36A,* dated Apr. 30, 1979.

"Extruded Header Line Series 440 and 441," *Malco Product Catalog 501-1.*

D&J Filter Type, *ITT Cannon* Catalog, D-14/Aug. 1979, pp. 14 and 15.

*Primary Examiner*—John McQuade

*Attorney, Agent, or Firm*—Joseph S. Tripoli; Robert L. Troike; William Squire

[57] ABSTRACT

A filtered connector comprises a low pass filter device located, in part, within a metal header, at least one electrode of the filter being soldered to the header. A connector pin passes through the filter. The header forms a shield for EMI radiated from the pin and serves also as a ground conductor for the one electrode. An EMI electrically conductive gasket between a housing and the header provides RF shielding between the two. The pin is supported within the housing and header by a dielectric plug which passes through an aperture in the housing and into an opening in the header, and is connected to the remaining electrodes of the filter device. The ends of the pin extending from the filter are shielded from each other by the header, gasket, and housing while the filter is grounded to the housing by the header and gasket.

3 Claims, 2 Drawing Figures

FILTERED CONNECTOR

Figure 1:
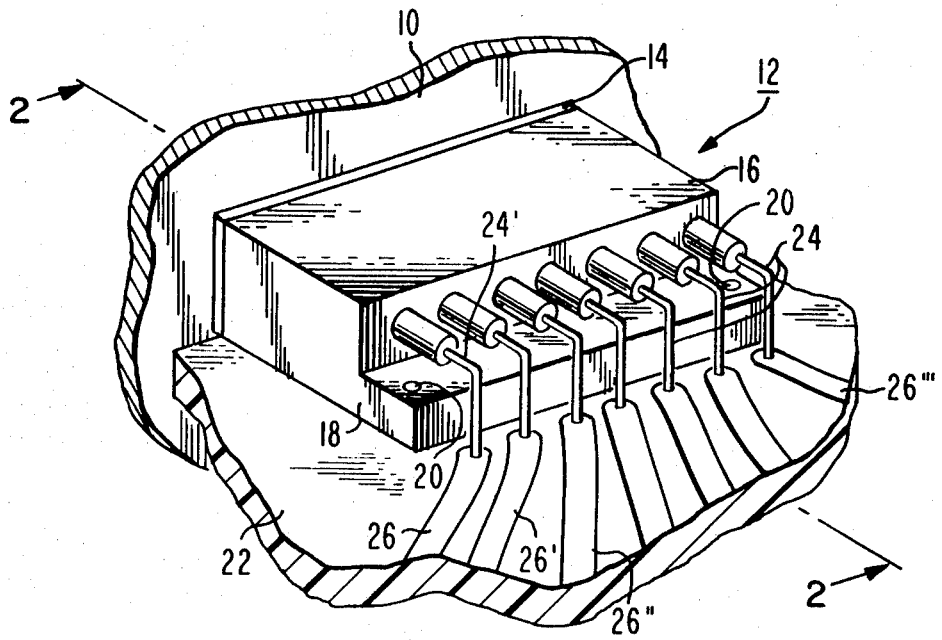

The Government has rights in this invention pursuant to Contract (or Grant) No. N00024-79-C-5714 awarded by the Department of the Navy.

The present invention relates to filtered connectors.

In certain electronic systems involving radiofrequency (RF) signals electromagnetic interference (EMI) is a significant problem. The interference can be reduced by shielding the circuits of the system. Further, the interconnect portion of the system, which may include cables, connectors, and the like, must be carefully configured to avoid radiation and conduction of EMI.

A variety of filtering devices and connectors have been developed and are commercially available to deal with the last aspect problem mentioned above. For example, ITT Cannon Electric Company makes filter contact assemblies for contact pins known as "DJ" devices, comprising a ferrite core, an inner contact element, and at least one capacitance element. A ground plane conductor is connected between the filter element and a metallic shell surrounding a dielectric material. The filter includes inductive, capacitive, and resistive elements for passing low frequency signals and for conducting to ground RF signals above a given frequency. These devices may be relatively fragile and precautions must be taken to avoid stressing them.

Spectrum Control Company produces filters which have a variety of selected insertion losses at different RF frequencies. These filters include ceramic material and are relatively fragile.

U.S. Pat. No. 4,020,430 discloses a contact pin surrounded by a filter device. The connector has a plurality of electrical contacts and includes a metal plate to which is secured a foil sheet having spring properties. The sheet is punched to form apertures defined by circumferentially spaced tines. EMI filters are press fitted within the apertures sandwiching the tines between the filters and the plate. The composite plane and foil provides a ground plate for the filters.

U.S. Pat. No. 4,144,509 discloses an electrical filter connector which includes a housing in which a dielectric insert member is positioned. A plurality of pin contacts extend through the dielectric member in parallel-spaced alignment for engaging complementary contacts on mating connectors. The ferrite sleeves positioned over the pin contacts coact with individual metal layers deposited on the front and rear surfaces of the dielectric block and a central metal layer within the block to form individual PI filter networks for each pin contact. Electric connections are maintained between the pin contacts and individual metal layers by solder bridges which extend over the ends of the ferrite sleeves.

U.S. Pat. No. 4,212,510 discloses a filtered header or feedthrough connector. Filter sleeves are soldered to each of a plurality of terminals. The terminal assemblies are inserted into a dielectric header housing in a fixed array. A conductive rubber gasket on the housing interconnects the filters to a ground plane. A metal bushing can be mounted on the conductive rubber gasket to mate with and interconnect to a bulkhead. The header housing accommodates filters of various sizes as well as terminal pins which pass straight through the housing and which are not connected to any filter. In this structure the filter is not exposed to mechanical stresses.

The connectors described above are relatively complex structures wherein a dielectric housing may be employed to provide structural support for the filter device and separate electrical conductor elements are employed to connect the filter ground electrode to ground. Further, the device may require additional elements to shield the filter's input and outputs from one another. This further complicates the structures.

A filtered connector in accordance with the present invention includes an electrically conducting body forming a connector housing and a dielectric plug at one surface of the body extending into the body. A radio frequency filter device is in the body and is ohmically connected to the body. The device and the plug are aligned on a common axis. The filter device may pass through a second surface of the body. An electrically conductive pin on the common axis passes through the plug and filter device and is connected to the device. The plug provides structural support for the pin and alleviates stresses on the filter device. The body serves multiple purposes, one as a ground terminal, eliminating the need for a separate ground lead conductor, another as an RF shield between the two portions of the pin which serve as input and output leads, respectively, for the filter, and another as the structural support for the plug.

Figure 2:
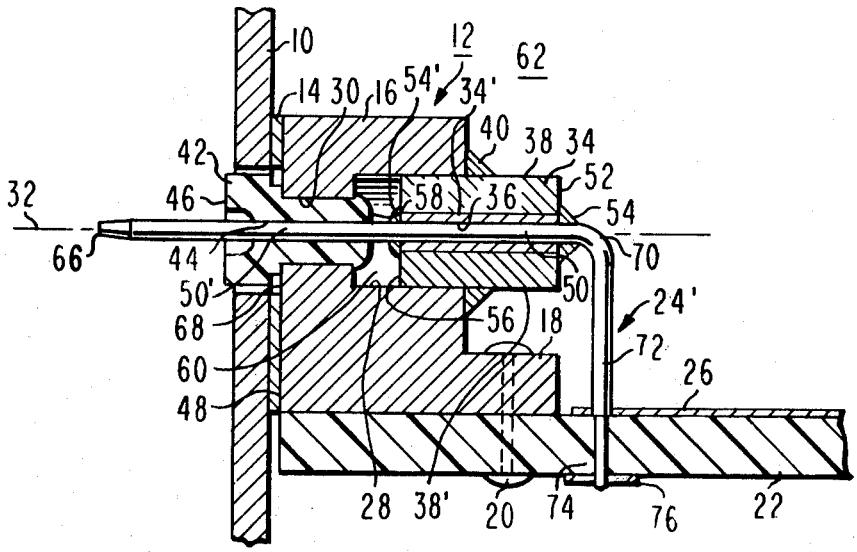

In the drawing:

FIG. 1 is an isometric view of a printed circuit board filtered connector embodying the present invention; and FIG. 2 is a sectional view of the connector of FIG. 1 taken along lines 2—2.

In FIG. 1 is a metal housing 10, such as one formed of aluminum, only a portion of which is shown, encloses electrical equipment to be EMI shielded. Connector 12 embodying the present invention is secured to the housing 10 with an EMI shielding gasket 14 which may be rubber loaded with electrically conductive material, for example conductive metal wires. The gasket serves also to provide a direct current connection between the metal header 16 (FIG. 2) portion of the connector 12 and the housing 10, grounding the connector 12 to housing 10. The metal header 16 has a flange 18 which is riveted by rivets 20 to a printed circuit board 22. The connector 12 has a plurality of connector pins 24, 24' disposed in an array and bent at right angles, although straight pins and suitable "jumpers" could be used. The pins are connected to corresponding circuit board conductors 26, 26', 26'', and so forth through 26'''. Each pin 24 is soldered to a different conductor on the printed circuit board. The pins 24 are positioned on 0.100 inch centers (spaced 0.100 inch center-to-center). This is a common spacing for printed circuit board and back plane wire wrap pins.

In FIG. 2, filtered connecting pin 24' is shown which is an example of the configuration of the remaining pins. The pin and filter construction of the remaining pins 24 is identical. Header 16 comprises a generally L-shaped aluminum member having two cylindrical bores 28 and 30 coaxial about axis 32. Bore 30 is smaller in diameter than bore 28 and is shorter in length. However, these relative dimensions are not critical. Closely received within bore 28 is a commercially available EMI PI type filter device 34 discussed below. Other types of filters, e.g., capacitive or inductive reactances, may be employed in the alternative.

The PI type filter illustrated by way of example, includes a series inductor (the ferrite core 34' in the field created by the current passing through pin 24' provides inductive reactance), and shunt capacitances each having an electrode at the respective end portions 52 and 56 connected between the ends of the inductor and ground. The pin passes through the bore 36 in the ferrite core 34'. Cylindrical electrode 38 is located centrally on the device's outer peripheral surface 38'. The remaining peripheral surface 38' is an electrical insulator formed by a ceramic substrate. Electrode 38 is thus electrically isolated from the ends 52 and 56 by the ceramic substrate. The ends 52 and 56 are connected by solder filets 54, 54' to spaced points along the pin 24' passing through the ferrite core 34', and electrode 38 is connected by solder fillet 40 to the header 16 which is at system ground. The equivalent circuit comprises a series inductance between ends 52, 56 and two shunt capacitances connected between the respective ends 52 and 56 of the inductance and ground.

Thus, in the PI filter described, the solder connections comprising fillets 54 and 54' of FIG. 2, are connected to the respective capacitor end electrodes, and solder filet 40 between the device 34 and the header 16 is connected to the other capacitor terminals. The device 34 provides high frequency (RF) filtering to ground between pin portion 50 and leg 72.

Dielectric plug 42, tightly received in bore 30, is described in United States Government specification MIL-C-28754/35B dated Apr. 30, 1979. This specification describes a male contact and insulator bushing set forming a removable wire-wrapped post terminal. The bushing disclosed in this specification is the same in construction as the plug 42. The plug 42 has a centrally-positioned bore 44 which is coaxial with surface 36 about common axis 32. Plug 42 has an end 46 which extends beyond the header planar face surface 48 which is perpendicular to axis 32.

A connecting pin 24', portion 50, circular or square in section, is in bore 44 and in bore 36 in filter 34. The pin portion 50 has a diameter which is closely received within the bore 44 of plug 42 so as to be retained therein. The pin 24', portion 50 is soldered to the end faces 52 and 56 forming the capacitor electrodes of the filter device 34 at respective fillets 54 and 54'. Other filters, e.g., capacitive types, need not have a fillet 54' as they are of different construction.

The header 16 at bores 28 and 30 forms with the filter device 34 a continuous electrical shield for any radiation in the cavity 60 formed by bores 28 and 30, adjacent region 50'. Header 16, being made of metal, gasket 14, and housing 10 serve to shield the housing 10 interior 62 from EMI radiation emitted by pin 24' at region 50. Thus, the filter removes to ground the high-frequencies conducted by pin 24' and the header 16 serves as a shield to prevent radiation from the lead portion 50' of pin 24' from being radiated toward the lead portion 70, 72 of pin 24' or vice versa.

Since the EMI gasket 14 abuts and is in contact with the housing 10 and the surface 48 of the header 16 surrounding pin portion 50', it provides EMI radiation shielding between the header 16 and the housing 10 with respect to radiation circuit by pin 24' at region 50'.

The pin 24' is bent at right angles at 70 forming leg 72 which is conveniently oriented for soldering to conductor 26 on one side of the printed circuit board 22. The leg 72 may have a narrower diameter portion which extends through the printed circuit board at 74 for connection to a conductor 76 on the opposite surface of the printed circuit board where applicable. A straight pin may be employed rather than the bent pin 24', and connected by a jumper wire to the printed circuit board.

Since the header 16 is connected to housing 10 which is at system ground and since it also shields radiation emitted by pin region 50' from interior 62, no further additional shielding and connections are required between the device 34 and system ground. Further, no additional connector elements are required to connect the printed circuit board conductor 26 to the outside world comprising wire-wrapped posts or the like on other circuit arrays. The 0.100 inch spacing of adjacent pins of the group 24 . . . 24' is particularly suitable for printed circuit board implementations. The ends 66 of adjacent ones of the pins 24, 24' are in the desired 0.100 inch center-to-center spacing and can be conveniently attached to wire-wrapped posts having suitable mating receptacles which are disposed in the same grid spacing.

In the above construction, because leg 72 is connected to a printed circuit board, it is relatively stationary and unstressed in use. In the alternative, if leg 72 were not bent at right angles, as shown, but extended coaxial with axis 32 and connected to printed board conductor 26 by a jumper wire (not shown), the device 34 still would remain relatively unstressed. However, end 66 is exposed to the outside world for connection to connectors. Any misalignment of the connectors mating with pin 24', end 66, tends to stress the pin by tending to bend the pin. This misalignment frequently occurs when connector pins are spaced 0.100 inch centers to meet conventional back plane grid spacings. The resulting stresses can cause the device 34 to fail—to fracture (the device 34 insulator being made of a ceramic, is relatively brittle). Because the header 16 is metal, it cannot serve as a support for region 50' of the pin 24' for obvious reasons. But plug 46 serves this important function in that it structurally supports the pin region 50' and absorbs stresses induced by mating female connector contacts at end 66. In its role as a housing, header 16 supports the filter in fairly rigid fashion; however, the plug 44 which is held in place by the header 16, supports the pin and prevents stresses at the end 66 of the pin from causing the brittle parts of the filter 34 to crack. A separate ground terminal is not needed as would be the case if the header were made of a dielectric material.

Other constructions, in the alternative, can employ assemblies comprising a pin, insulator, and filter in the array of FIG. 1 in which there is an additional array above the array of FIG. 1 in the same header 16. The header in that case is greater in vertical height than the one shown in FIG. 1 to accommodate these additional arrays of pins and filters. Also, the legs such as legs 72 may contact the printed circuit board to the right of legs 72 in FIG. 2. In FIGS. 1 and 2, apertures (not shown) may be formed in header 16 to secure it to the housing 10.

The resulting connector structure meets the United States Navy standard electronic module specifications (SEM) which are industry wide standards. Such connectors are sometimes referred to as SEM connectors.

What is claimed is:

1. A radio-frequency filtering connector for use with a printed circuit board comprising:

an electrically conductive body having first and second coaxial cylindrical bores, said body including means for securing said body to said printed circuit board;

a dielectric plug closely received in said first bore, said plug having a bore coaxial with said first and second bores and concentric therewith, said plug tending to absorb stress induced by an applied force;

a radio-frequency filter device closely received in said second bore and rigidly mechanically supported by said body at the interface with said second bore, said device including a plurality of electrodes, at least one of said electrodes being ohmically connected to said body, said device comprising elements for conducting electrical signals in a given frequency range between the one and the remaining ones of said electrodes, said device including a fragile insulator which tends to fracture in response to stress having a bore coaxial with said plug bore and concentric with said first and second bores; and an electrical conductor pin coaxial with and passing through said plug and filter device bores extending beyond said plug at one end and beyond said filter device at the other end, said pin being closely received within said plug bore, said pin being ohmically connected to the remaining device electrodes whereby said device ohmically conducts signals in a certain frequency range from said pin to said body, said pin and filter device being related such that bending of the pin relative to the filter device can stress and possibly fracture said insulator whereby said plug structurally supports said pin and absorbs stresses induced by the bending of said pin portion extending beyond said plug bore.

2. The connector of claim 1 including an array of said first and second bores, a like array of said plugs in said first bores, a like array of said devices in said second bores, and a like array of said pins each passing through a corresponding plug and filter device and lying in parallel planes.

3. The connector of claim 1 wherein said plug extends beyond the end of said first bore and said filter device extends beyond said body.

* * * * *